United States Patent [19]

Martinec

[11] 4,199,839

[45] Apr. 29, 1980

[54] SUCTION CLEANER POWER NOZZLE CONSTRUCTION

[75] Inventor: Eugene F. Martinec, East Cleveland, Ohio

[73] Assignee: Health-Mor, Inc., Cleveland, Ohio

[21] Appl. No.: 950,733

[22] Filed: Oct. 12, 1978

[51] Int. Cl.[2] ..... A47L 5/34

[52] U.S. Cl. ..... 15/354; 15/377

[58] Field of Search ..... 15/377, 368, 354

[56] References Cited

U.S. PATENT DOCUMENTS

| | | | |
|---|---|---|---|
| 3,354,496 | 11/1967 | Jonsson | 15/377 |
| 3,818,540 | 6/1974 | Martinec et al. | 15/377 X |
| 3,942,216 | 3/1976 | Minton | 15/416 X |

FOREIGN PATENT DOCUMENTS

| | | | |
|---|---|---|---|
| 1301707 | 7/1962 | France | 15/377 |

*Primary Examiner*—Christopher K. Moore

*Attorney, Agent, or Firm*—Frease & Bishop

[57] ABSTRACT

A suction cleaner power nozzle has auxiliary, main and bottom plate members releaseably assembled to form a nozzle housing having separated upper and lower compartments. The lower compartment includes a nozzle mouth in which a rotary brush is located. Support wheels and wheel height adjusting mechanism also are located in the lower compartment. Brush drive motor means are located in the upper compartment, and the auxiliary housing member is replaceable without disassembly of the remainder of the nozzle or its components.

7 Claims, 19 Drawing Figures

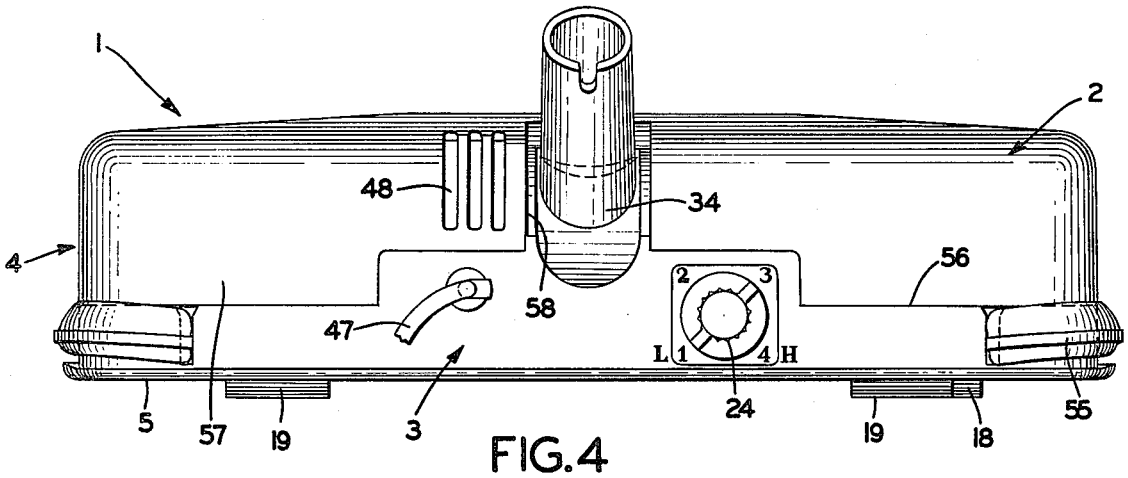
FIG. 4
FIG. 5
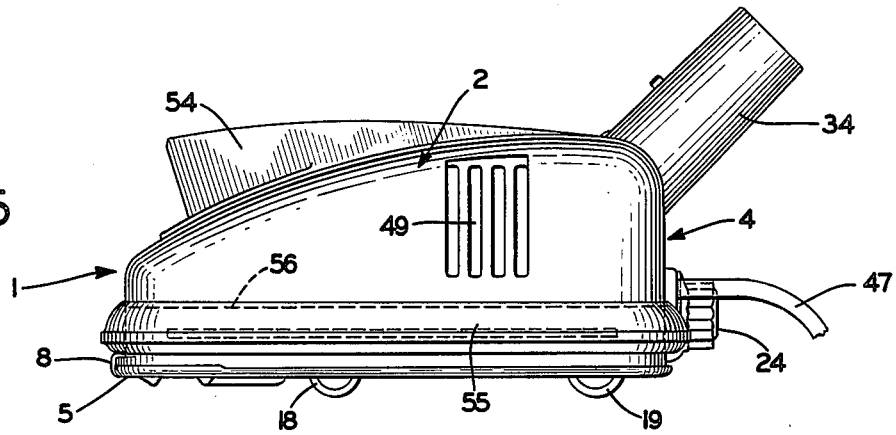
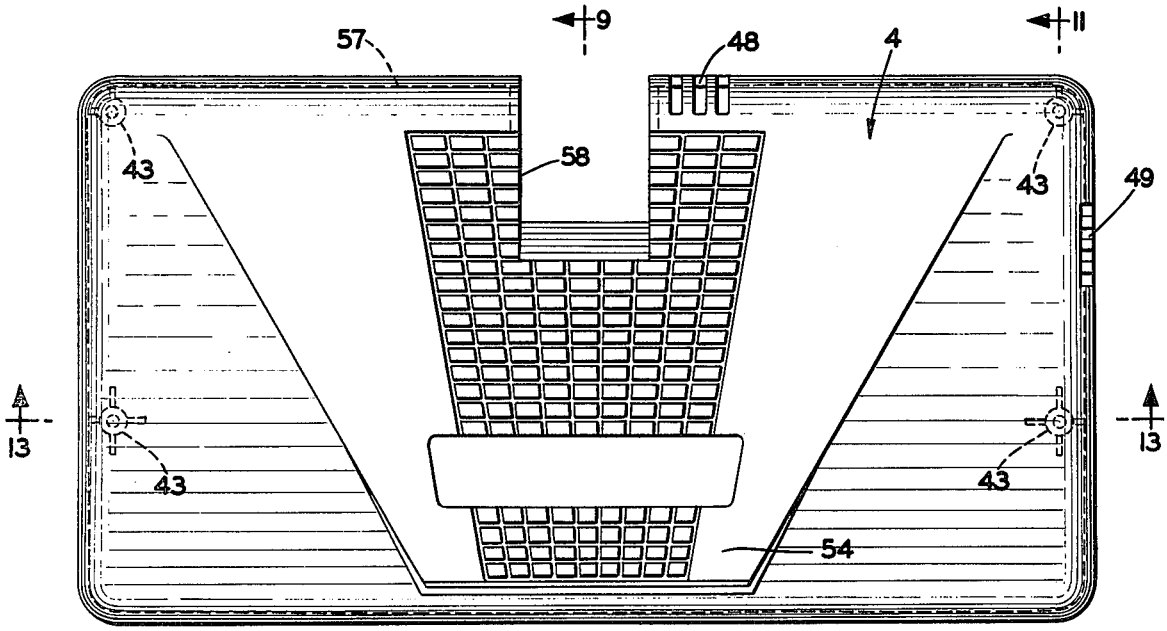
FIG. 6

FIG. 7
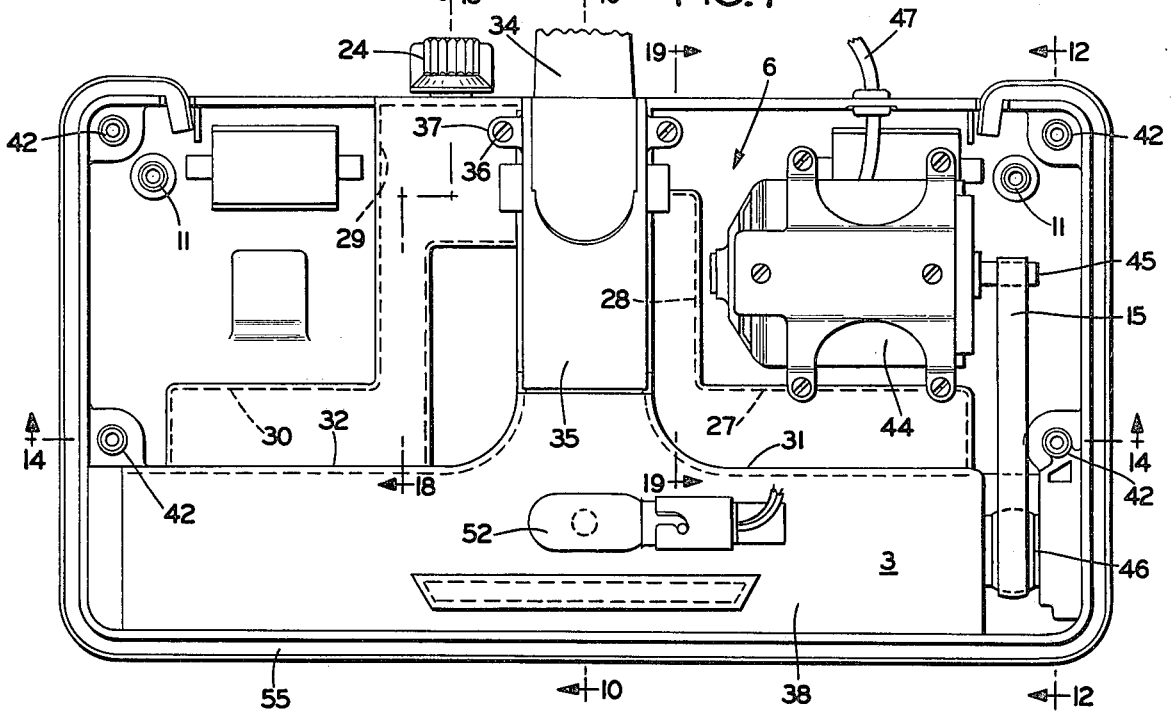
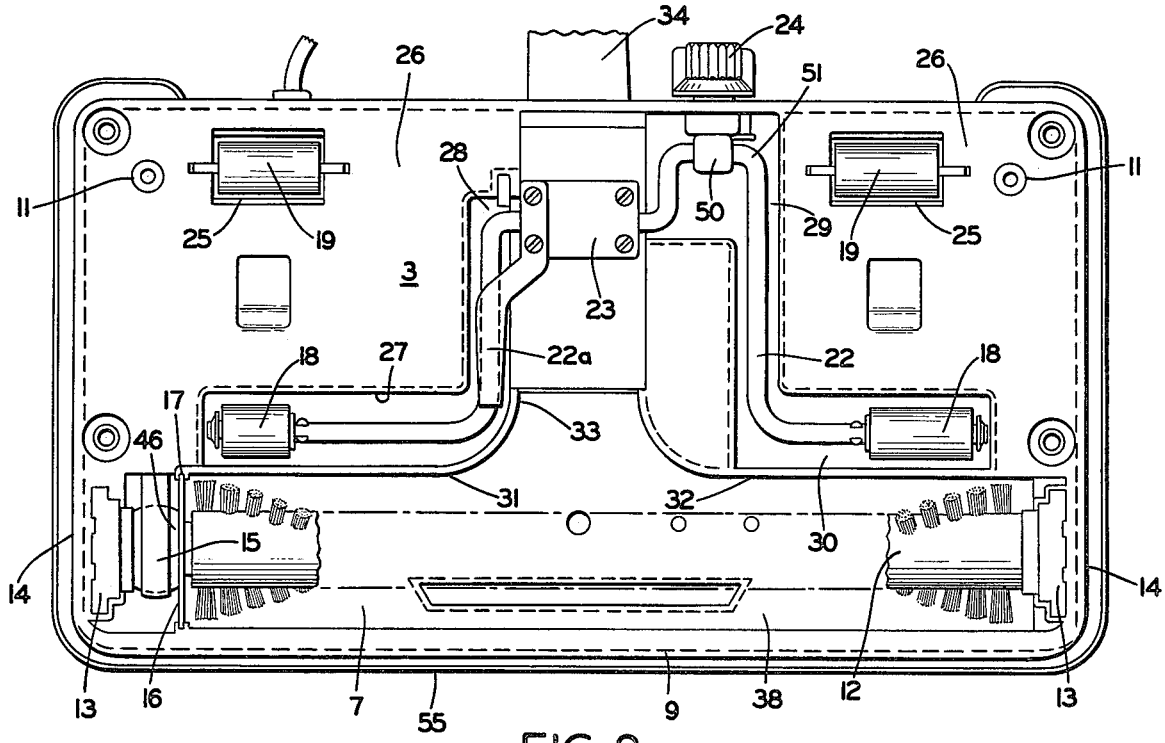
FIG. 8

SUCTION CLEANER POWER NOZZLE CONSTRUCTION

BACKGROUND OF THE INVENTION

1. Field of the Invention

The invention relates to a new construction of a suction cleaner nozzle of a type having a power driven rotary brush mounted within the nozzle housing; and having a housing bottom plate formed with a nozzle inlet opening adjacent the rotary brush; and also having adjustable nozzle supporting wheels located within the housing and projecting through openings in the bottom plate; and also having a wheel height adjusting mechanism located within the nozzle housing; and also having a motor located in the nozzle housing for driving the rotary brush; and also having suction passages in the housing leading from the nozzle opening to a tubular connector which is detachably connected with the lower end of a wand that also may carry an electrical supply cord to supply power to the rotary brush motor.

2. Description of the Prior Art

Prior art power nozzles such as shown, for example, in Martinec et al U.S. Pat. Nos. 3,818,540 and 4,023,234 frequently include a main nozzle housing member formed of molded plastic material. Such main housing member usually has a generally rectangular cup-shaped form with integral top, end, front and back walls. The main housing member is closed with a metal housing bottom plate which is removable from the main housing member for gaining access to several compartments formed by the bottom plate and the main cup-shaped member and partitions extending from the top wall of the cup-shaped member. One of these compartments forms a nozzle mouth in which a power driven rotary brush is located. The partitions extending from the top wall of the cup-shaped housing member to the removable bottom plate also form a main suction passage or duct communicating between the nozzle mouth and a tubular connector for the wand. The other compartment contains the brush drive motor, the drive belt, the supporting wheels, and the wheel adjusting mechanism.

No true and effective seals against air flow between the two compartments in the prior structures have been provided. As a result, such prior power nozzles generally have been plagued with a problem relating to lint which collects in both compartments in the nozzle housing.

Such lint collects and builds up in the nozzle mouth and main suction duct connecting between the nozzle mouth and the tubular connector. Lint also collects and builds up within the other compartment in and around the brush drive motor and the adjusting mechanism for the wheels. If an electrical defect happens to occur in the brush drive motor, the motor may heat up and can set fire to the lint collected adjacent the motor. There have been instances of such fires.

Also, lint builds up in the main suction duct may have a sufficient volume to reduce the amount of air flow from the power nozzle through the wand to the main tank unit to prevent proper cooling of the main motor in the tank. As a result, the main motor heats up and can burn out since cooling is dependent upon an adequate volume of main air flow.

Further, such prior power nozzles usually are sold as attachments for tank type suction cleaning apparatus for use in power driven brush suction rug cleaning operations.

Such tank type suction cleaning apparatus and their power nozzle attachments frequently are sold following household demonstrations and under time-payment contracts. At times, such apparatus and power nozzles are repossessed as a result of the customer deciding not to purchase the apparatus or failing to make the purchase payments for the apparatus.

The outer molded surface of the plastic cup-shaped main nozzle housing member when new desirably has an attractive, smooth polished surface. This surface, however, frequently becomes scratched, marred or otherwise streaked in use from rubbing against furniture or other articles when performing a cleaning operation. This detracts from and mars the appearance of the polished plastic material housing member surface.

Despite the fact that the various mechanical devices and mechanisms within such power nozzle may be in perfect condition and almost new when a power nozzle attachment is repossessed; the marred or scratched appearance of the outer plastic housing member surface prevents the power nozzle from being reconditioned for later sale or use without completely dismantling the entire unit and reassembling the parts thereof in a new main plastic nozzle housing member. Such tearing down and reassembling of an entire suction cleaner power nozzle unit to replace the main plastic nozzle housing member is very costly and economically undesirable.

Another known prior art power nozzle, quite different from those shown in U.S. Pat. Nos. 3,818,540 and 4,023,234, has a housing formed by a removable metal top plate and a main bottom member having a bottom wall substantially flush with the nozzle mouth. The nozzle mouth opening lips are formed by a separate removable narrow metal plate having opening slots immediately below the power driven rotary brush. A special nozzle mouth compartment for the unit is formed by a narrow elongated component, half-round in cross section, located above the nozzle lip forming metal plate. The rotary brush is mounted in the unit between the narrow metal lip opening plate and the narrow half-round component. This half-round nozzle mouth component is accessible for assembly and removal when the upper housing top plate is removed.

This prior power nozzle has three wheels or rollers that are journaled in recessed cavities formed in the underside of the main housing bottom member to the rear of the narrow metal lip forming plate. The wheels have a fixed location and are not adjustable and have no adjusting mechanism.

Thus, a need exists in the tank type suction cleaner field for a power nozzle construction of the general type described, which eliminates the "lint" problems, which enables a repossessed power nozzle having marred plastic nozzle housing member outer surfaces to be economically restored without disassembly and reassembly of the entire unit to present a new unblemished polished outer housing surface appearance, which is provided with supporting wheels some of which extend through openings in the nozzle housing bottom plate and are adjustable, and which also is provided with wheel height adjusting mechanism located within the nozzle housing in a compartment separate from that in which the brush motor is located.

SUMMARY OF THE INVENTION

Features of the invention include providing a power nozzle construction in which nozzle chamber and airflow passage lint collection, which may cause overheating of brush drive and tank unit motors, is substantially eliminated to eliminate overheating and fire problems, providing a housing formed with two separated compartments in one of which the nozzle brush drive motor is housed and in the other of which adjusting mechanism for nozzle support wheels is housed; providing three housing members that are releaseably assembled with simple accessible connecting means to form the nozzle housing and the two described compartments; providing for ready replacement of the upper outer housing member without dismantling the remaining housing members or components in the housing compartments; and providing a new construction, characterized by the foregoing advantageous features which eliminate difficulties heretofore encountered and satisfy needs existing in the art.

A new suction cleaner power nozzle constructed which includes the new features and concepts of the invention comprises a main housing member, an auxiliary housing member, and a housing bottom plate member which form the nozzle housing; externally accessible means connecting the bottom plate and main housing members; means accessible externally through openings formed in the bottom plate member connecting the main and auxiliary members; the main member being located intermediate the auxiliary and bottom plate members, and said members when assembled having walls forming an upper compartment between the main and auxiliary members and a lower compartment between the main and bottom plate members; a rotary brush journaled in the lower compartment; a brush drive motor mounted in the upper compartment; drive belt means operatively connecting the drive motor and rotary brush; adjustable nozzle support wheels and wheel height adjusting mechanism located in the lower compartment; and said adjustable wheels being movable to various adjusted positions through openings formed in the bottom plate member.

BRIEF DESCRIPTION OF THE DRAWINGS

A preferred embodiment of the invention—illustrative of the best mode in which applicant has contemplated applying the principles—is set forth in the following description and shown in the drawings and is particularly and distinctly pointed out and set forth in the appended claims.

FIG. 4 is a rear view of the unit shown in FIGS. 1, 2 and 3;

FIG. 5 is an end view of the unit shown in FIGS. 1–4 looking toward the right end of FIG. 2;

FIG. 6 is a top plan view of an auxiliary molded plastic housing member component of the nozzle housing provided in accordance with the new concepts of the invention;

FIG. 7 is a top plan view similar to FIG. 1 with the auxiliary housing member of FIG. 6 removed;

FIG. 8 is a bottom plan view similar to FIG. 3 with the bottom plate member removed;

Similar numerals refer to similar parts throughout the various figures of the drawings.

DESCRIPTION OF THE PREFERRED EMBODIMENT

The improved construction is illustrated and described herein with reference to a known general type of suction cleaner power nozzle attachment unit having various usual components. The new concept is characterized by molded plastic housing means comprising main and auxiliary housing members or components detachably assembled together to form with a metal bottom plate two distinct housing compartments completely separated one from the other. A nozzle wheel adjusting mechanism is located in one of the compartments and a brush drive motor is located in the other compartment. The device is further characterized in that the auxiliary housing member may be readily removed and replaced by a new auxiliary member without disturbing the remainder of the power nozzle unit or its components.

Figure 15:
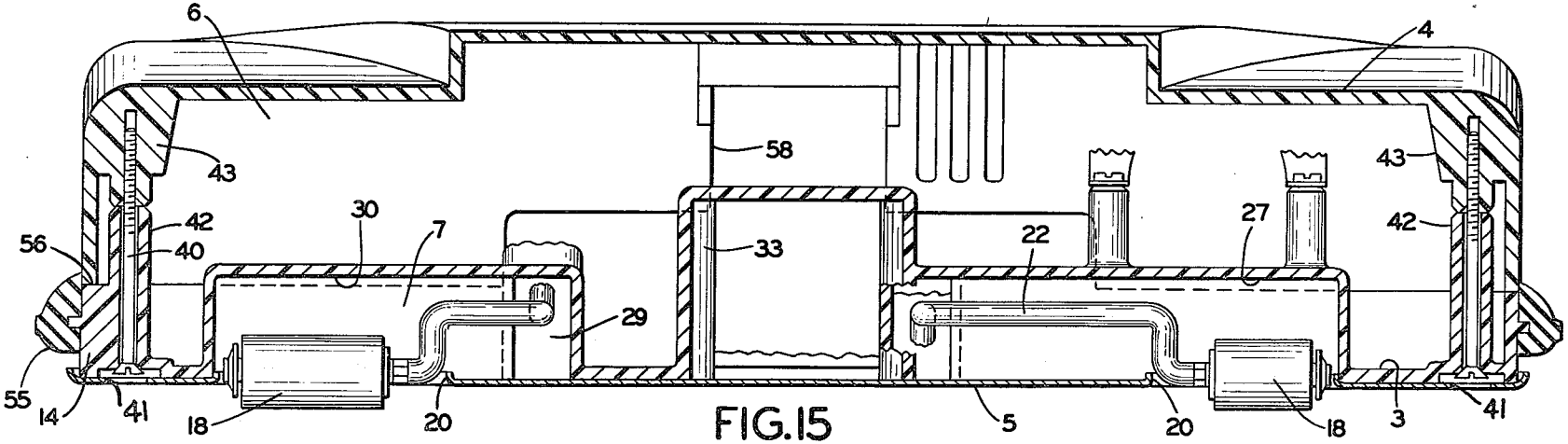
FIG. 15 is a view similar to FIGS. 13 and 14 with the housing components of FIGS. 13 and 14 assembled along with the nozzle bottom plate member, the section plane being the same as those for FIGS. 13 and 14.
Figure 16:
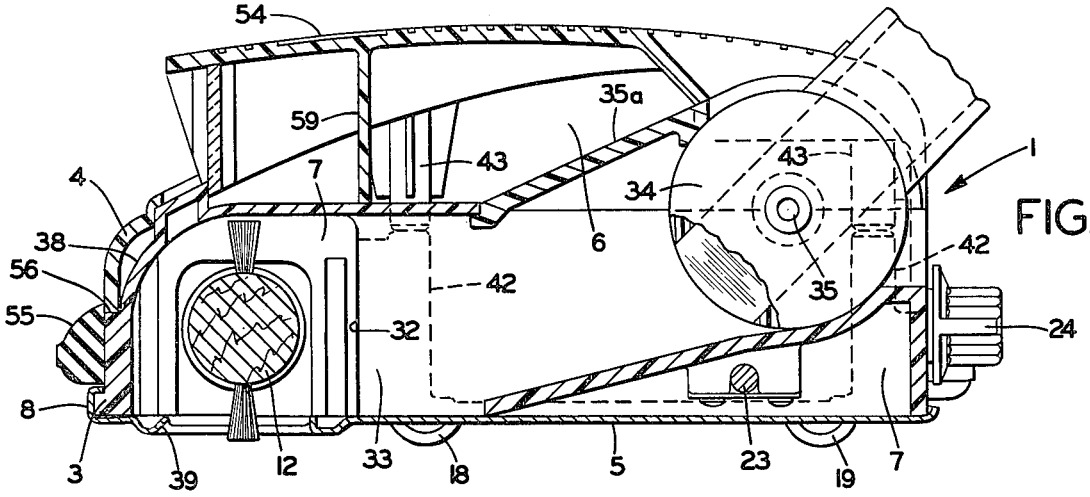
FIG. 16 is a sectional view similar to FIGS. 9 and 10 and taken on the same section plane as those of FIGS. 9 and 10 showing the housing components and nozzle bottom plate assembled.
Figure 17:
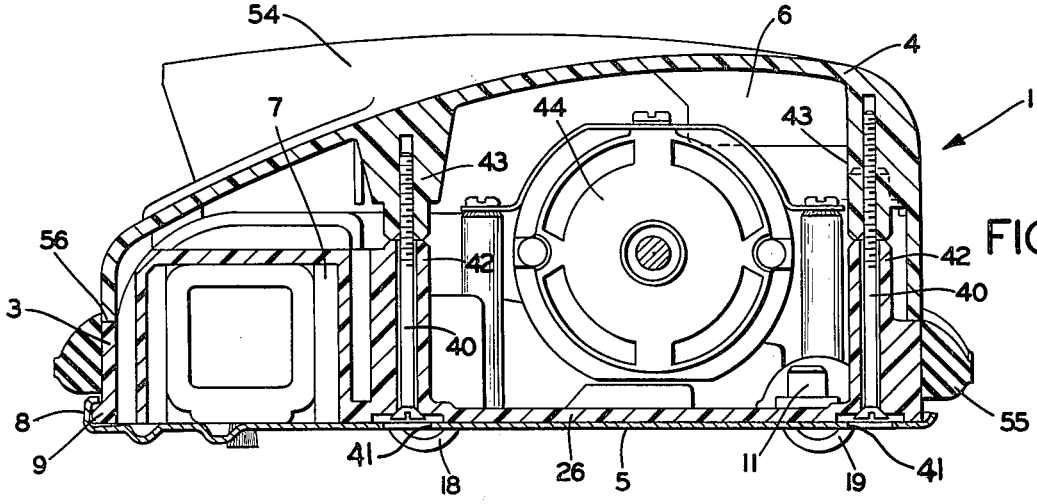
FIG. 17 is a sectional view similar to FIGS. 11–12 and taken on the same plane as those of FIGS. 11 and 12 showing the components of FIGS. 11 and 12 and the nozzle bottom plate assembled.

The new suction cleaner power nozzle unit is indicated generally at 1 and includes housing means generally indicated at 2 composed of a plastic main housing member 3, an auxiliary plastic housing member 4 and a preferably metal housing bottom plate 5 (FIGS. 15, 16 and 17). When the members 3, 4 and 5 are assembled as best shown in FIGS. 15, 16 and 17, upper and lower compartments 6 and 7 are formed, the upper compartment 6 between main and auxiliary members 3 and 4 and the lower compartment 7 between main and bottom plate members 3 and 5.

The front edge of the bottom plate 5 is formed with a hook-shaped 8 which engages a flange 9 at the bottom of the front wall of the main member 3 (FIGS. 16 and 17). Screws 10, preferably two in number, located adjacent the rear corners of the bottom plate 5 (FIG. 3) are used to complete the assembly of the bottom plate 5 to the main housing member 3. The screws 10 are threaded into bosses 11 formed in member 3 (FIGS. 7, 8, 12 and 17).

Figure 3:
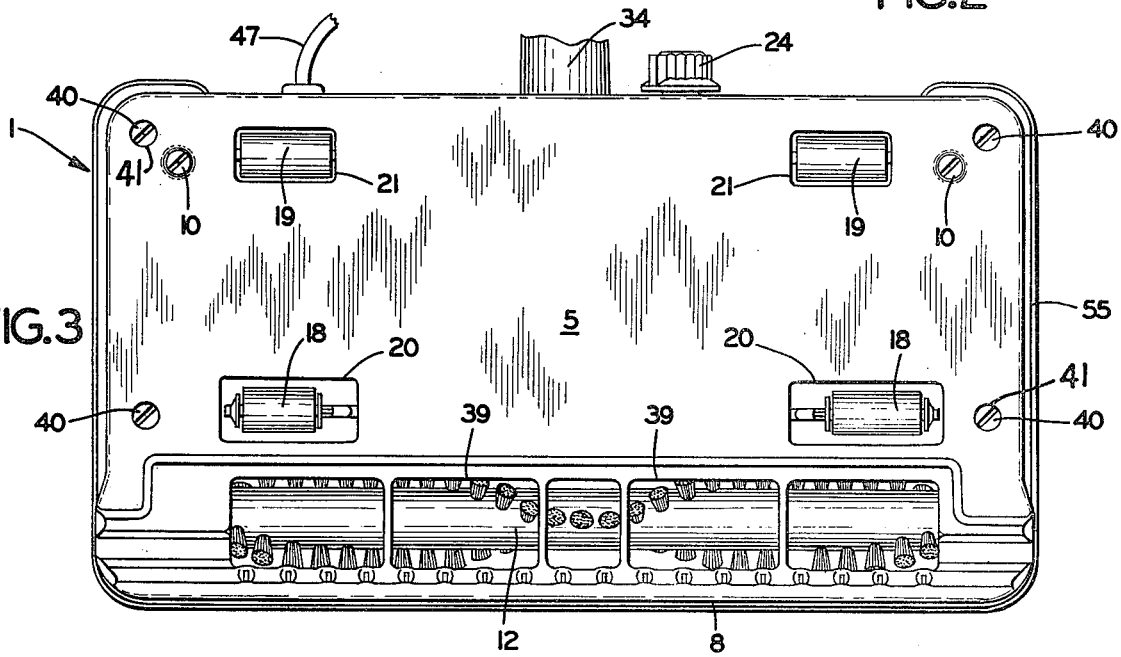
FIG. 3 is a bottom plan view of the unit shown in FIGS. 1 and 2.
Figure 9:
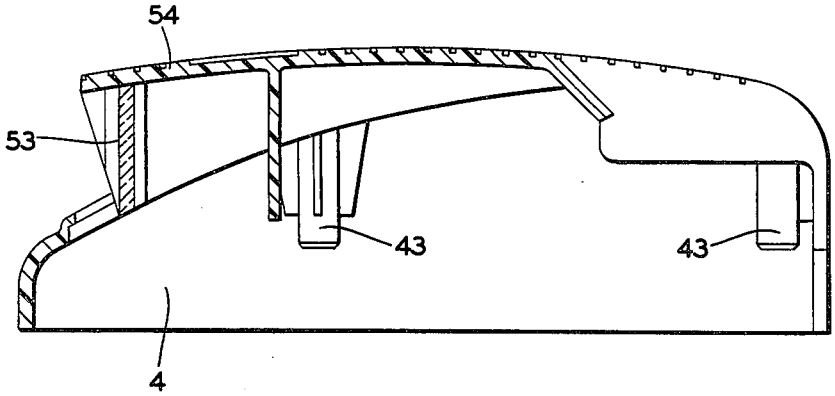
FIG. 9 is a sectional view of the auxiliary housing member looking in the direction of the arrows 9—9, FIG. 6.

Referring primarily to FIGS. 3 and 8, upon removal of the bottom plate 5 by removing screws 10 and unhooking the engagement 8 and 9 between the bottom plate 5 and main member 3, the lower compartment 7 is exposed as shown in FIG. 8. The usual rotary brush 12 is located in compartment 7 and is journaled in bearings 13 suitably mounted adjacent the end walls 14 of main member 3 near to its front corners.

The brush 12 and bearings 13 are removable and may be adjustable in a known manner for compensating for bristle wear and for replacing the brush drive belt 15. In order to maintain separation between the upper and lower compartments 6 and 7 while accommodating the brush drive, a rectangular slidable partition wafer 16 is assembled to the brush 12 adjacent its end as shown in FIG. 8. Wafer 16 is slidably engaged in grooves 17 formed in the main member 3.

Figure 10:
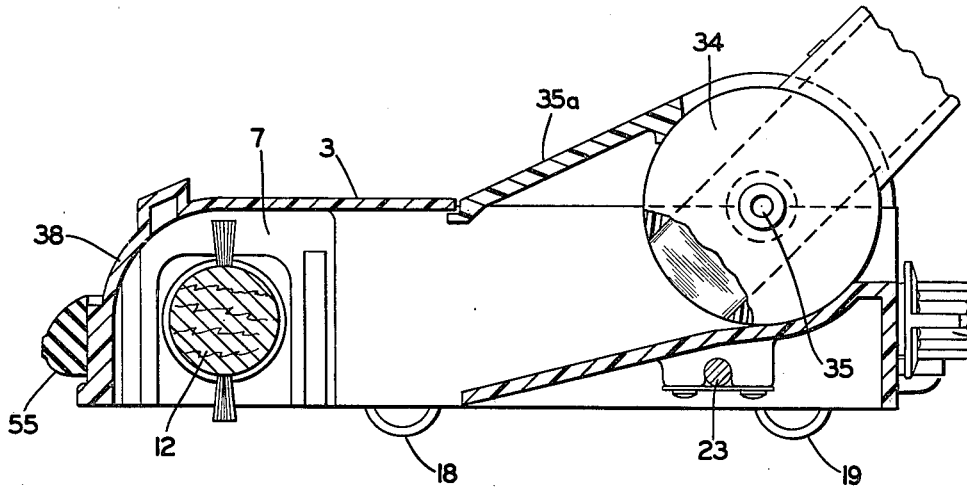
FIG. 10 is a sectional view looking in the direction of the arrows 10—10, FIG. 7.
Figure 11:
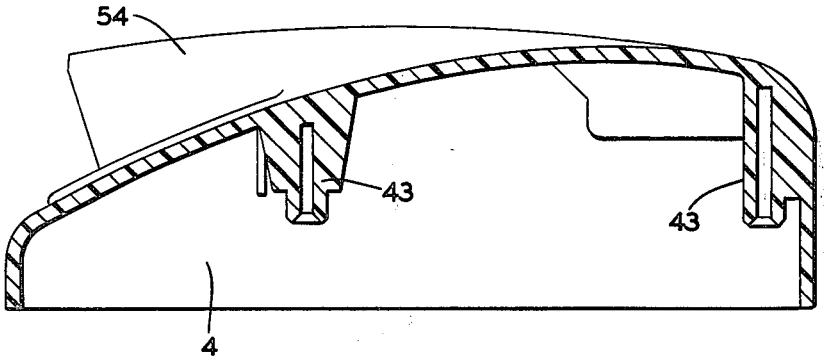
FIG. 11 is a sectional view looking in the direction of the arrows 11—11, FIG. 6.
Figure 12:
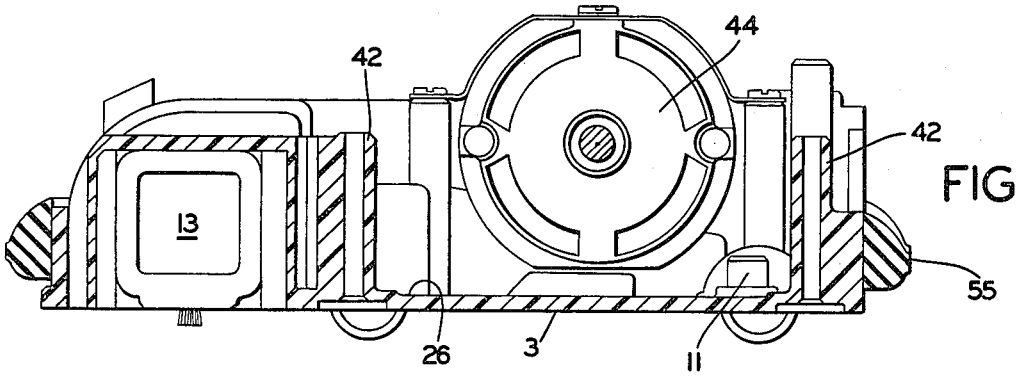
FIG. 12 is a sectional view looking in the direction of the arrows 12—12, FIG. 7.

The unit 1 when used for cleaning rugs, floors and the like, is supported on pairs of wheels or rollers 18 and 19 (FIG. 3) which project through corresponding openings 20 and 21 formed in the bottom plate 5. The rollers 18 are adjustable and are journaled on the ends of lever 22 which is pivotally mounted at 23 on the underside of main housing member 3 (FIGS. 8 and 10). The pivoted lever 22 is biased to raise the rollers 18 normally upward into housing compartment 7 by spring finger 22*a*. Lever 22 has a number of adjusted positions and is actuated by turning knob 24 to any one of the four positions indicated by numerals in FIG. 4. This roller height adjusting means typically is used for power nozzles as shown in U.S. Pat. No. 3,818,540.

Rollers 19 are located near to the rear of the nozzle unit 1 and are journaled in recesses 25 formed in and extending upwardly from the under surface of the lower horizontal wall portion 26 of the main member 3.

As shown in FIG. 8, the lower horizontal wall portion 26 of main housing member 3 is recessed upwardly at 27, 28, 29 and 30 to accommodate the shape, position and movement of the lever 22. The recess portions 27, 28, 29 and 30 form portions of the lower nozzle compartment 7.

Partitions 31 and 32 extend downward from recessed portions 27 and 80, respectively, of the main housing member 3 (FIG. 8) to form the elongated main nozzle mouth and the throat 33 which leads to and connects with the typical movable tubular connector member 34 journaled at 35 (FIG. 10) between the main member 3 and connector journal cap member 35*a*. The cap member 35*a* is secured to the main member 3 by screws 36 engaging ears 37 on the cap member 35*a* (FIG. 7).

The main nozzle mouth formed by partition walls 31 and 32 and the curved front wall 38 of the main member 3 is located above the nozzle lip openings 39 formed in the bottom plate 5 (FIGS. 3, 7, 8 and 16).

The portions of the partitions 31 and 32 which form the throat 33 provide the main suction duct or passages for air currents drawn into the nozzle by the suction existing in a usual wand (not shown) when engaged with the movable tubular connector 34. The wand is connected in a usual manner by a flexible hose (not shown) with a tank type cleaner having a main motor driven fan which provides the suction for the power nozzle or other nozzle attachments connected to the wand.

Figure 1:
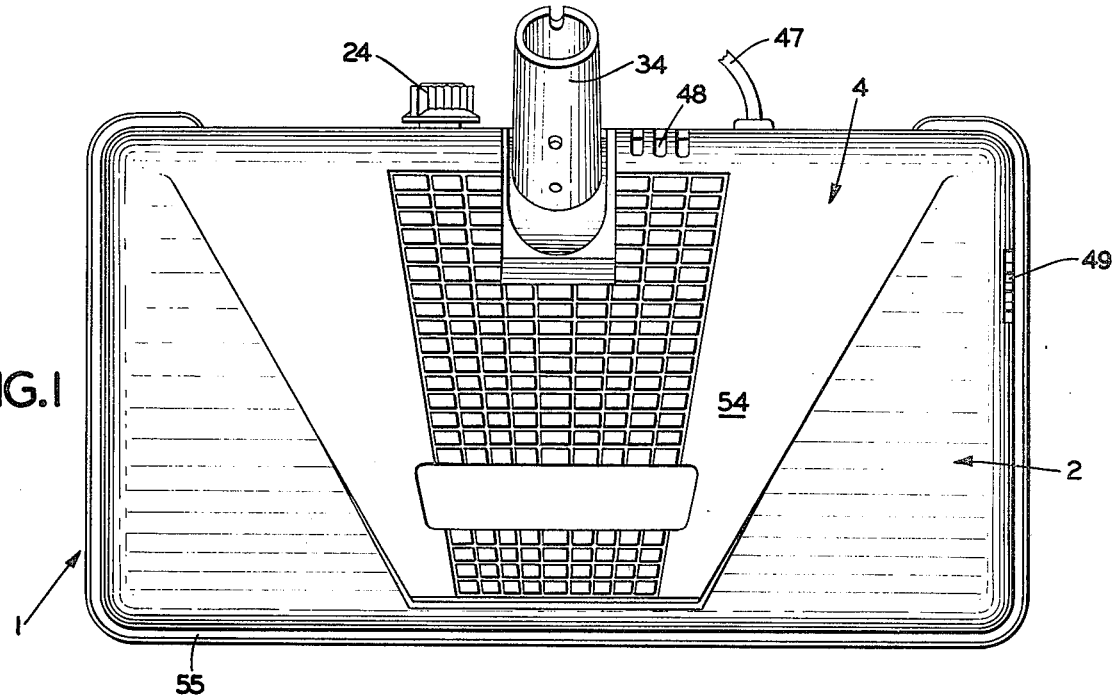
FIG. 1 is a top plan view of the new power nozzle construction, which is generally rectangular in shape.
Figure 2:
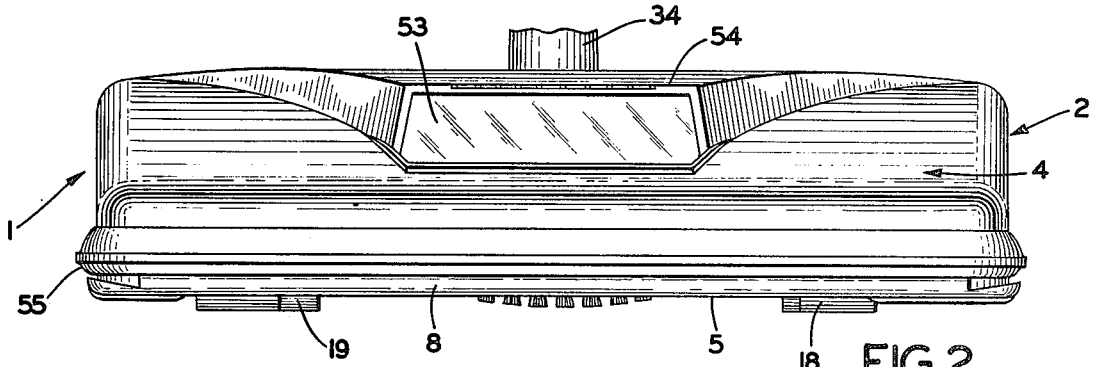
FIG. 2 is a front view of the power nozzle unit shown in FIG. 1.

Referring to FIGS. 1, 3 and 7, the auxiliary housing member 4 may be removed by removing four screws 40 generally located adjacent the corners of the unit 1 (FIG. 3) and which are accessible through openings 41 formed in the metal bottom plate 5. The screws 40 extend through tubular bosses 42 formed in the main member 3 and thread into threaded bosses 43 formed in auxiliary member 4 (FIGS. 11, 12, 15 and 17).

When the auxiliary member 4 is removed (FIG. 7), the components in the upper compartment 6 are exposed, including the brush drive motor 44, and the brush drive belt 15 which engages the motor shaft 45 and one end 46 of the rotary brush 12.

The motor 44 is supplied with power by an electrical cord 47 which may plug into a supply cord mounted on the wand (not shown) which is connected to the main cleaner tank unit power supply in a usual manner.

Thus, the motor 44 is located in the compartment 6 and is completely separated from the compartment 7 formed by the underside of the main housing member 3. In this manner the motor 44 and upper compartment 6 are substantially free of lint collection originating from dust laden suction air currents. Motor 44 is cooled by self-contained fan means which circulates cooling air through the motor. Such air passes into or out of the upper compartment 6 through slot openings 48 and 49 formed in the rear and end walls of the auxiliary member 4 (FIGS. 4, 5 and 6).

Figure 18:
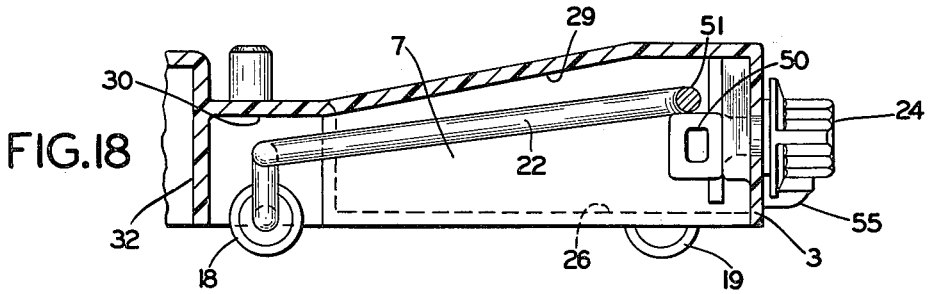
FIG. 18 is a fragmentary sectional view taken on the line 18—18, FIG. 7.
Figure 19:
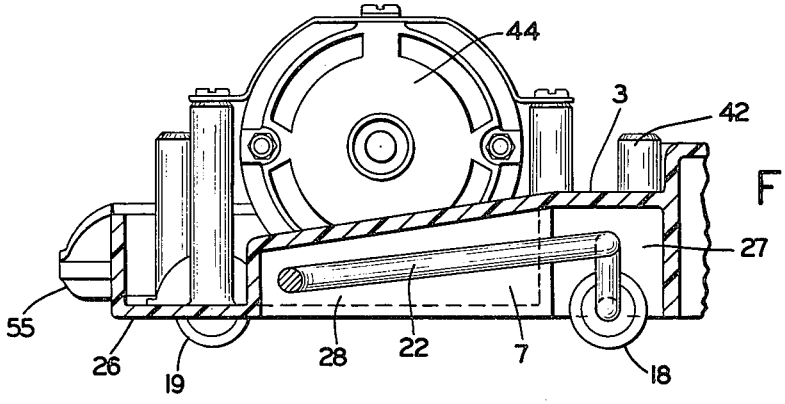
FIG. 19 is a fragmentary sectional view looking in the direction of the arrows 19—19, FIG. 7.

Referring to FIGS. 4, 8 and 18, the wheel adjusting knob 24 has a shaft extending through the rear wall of housing member 3, and an eccentric block 50 is mounted on the knob shaft within recess 29 of compartment 7, which engages offset portion 51 of lever 22 for adjusting the position of the lever to change the position of wheels 18.

The power nozzle unit 1 may be provided with a headlight 52 which shines through a window 53 mounted in an opening formed in a raised portion 54 of the top wall of the auxiliary member 4. The power nozzle 1 also is provided with a usual soft rubber bumper strip 55 extending around the lower portions of the front and ends of the unit and around the rear corners to protect wall baseboards and furniture from being marred or scratched by the nozzle unit during cleaning operations. The bumper 55 conceals the line 56 presented by the abutment of the main and auxiliary members 3 and 4 when assembled as shown in FIGS. 15, 16 and 17.

Figure 13:
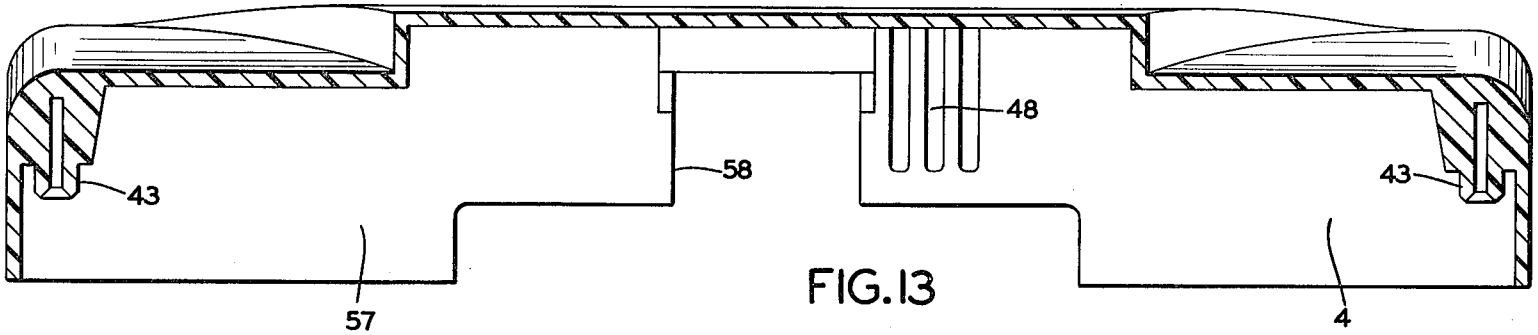
FIG. 13 is a sectional view looking in the direction of the arrows 13—13, FIG. 6.
Figure 14:
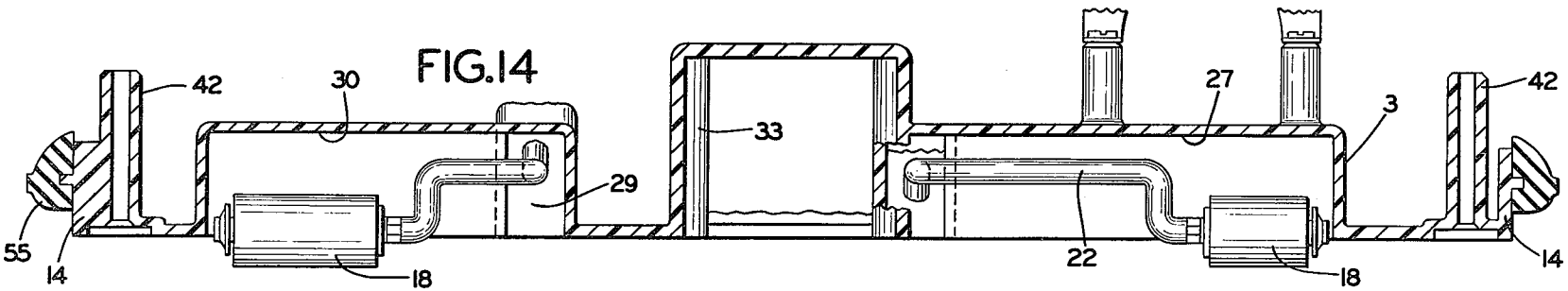
FIG. 14 is a sectional view looking in the direction of the arrows 14—14, FIG. 7.

The auxiliary member 4, shown removed from the main member 3 in FIGS. 6, 9, 11 and 12 has a rear wall 57 which is notched as best shown in FIG. 13 to engage wall portions of the main member 3 which form the recesses 27, 28, 29 and 30 when the members 3 and 4 are assembled as shown in FIGS. 15, 16 and 17. The central notch 58 accommodates the journal cap member 35 for the tubular connector member 54.

The auxiliary member 4 also has a partition wall 59 (FIGS. 9 and 16) which assists in defining the upper compartment 6 by engagement with the top wall of the main member 3 in the region of the nozzle mouth and suction dust throat 33 which are formed by the partitions 31 and 32. The nozzle mouth and suction duct comprise parts of the lower compartment 7. Also, as shown in FIGS. 1, 3, 7 and 8, the rectangular shape of the housing means 2 is developed by providing the nozzle housing members 3, 4 and 5 with substantially the same rectangular dimensions.

Thus, a power nozzle unit 1 which may have a scratched or otherwise marred outer housing surface, seen by viewing FIGS. 1, 4 and 5, may be restored to new condition in appearance by replacing a scratched rectangular auxiliary member 4 with a new member, such as shown, per se, in FIG. 6, simply by removing the four assembly screws 40 accessible at the underside of the corners of unit 1 as shown in FIG. 3, then removing the marred member 4, and then assembling a new member 4 with the screws 40. The time required for such restoration is minimal and the cost also is minimal because the member 4 preferably is an inexpensive injection-molded rectangular plastic part.

The concept of forming upper and lower compartments in the housing means 2 composed of three members 3, 4 and 5 with the main housing member 3 being located intermediate the auxiliary member 4 and the bottom plate 5, which thereby provide completely separated upper and lower compartments 6 and 7 and which separated compartments accommodate the use of and mounting of adjustable wheels and wheel adjusting mechanism in the lower compartment 7 and the mounting of brush drive motor 44 in the upper compartment 6, provides a solution for the "lint" problem described so as to substantially eliminate the possibility of burning out either the power nozzle brush drive motor 44 or the main suction motor in the main tank unit as a result of the accumulation of lint.

The same concept also provides for restoring at minimal effort and cost a marred or scratched housing.

Accordingly, the new concept and construction of rectangularly-shaped suction cleaner power nozzles of the invention solve the problems that have existed in the art and obtain the new results described.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the power nozzle is constructed, assembled and operated, the characteristics of the new construction, and the advantageous, new and useful results obtained, the new and useful structures, devices, elements, arrangements, parts, and combinations are set forth in the appended claims.

I claim:

1. In suction cleaner power nozzle construction of the type having a housing, a power driven rotary brush in the housing, adjustable nozzle supporting wheels in the housing, wheel height adjusting mechanism in the housing, a rotary brush drive motor in the housing, suction mouth and main suction duct passages in the housing, and a movable tubular wand connector journaled in the housing; the combination of a main housing member, an auxiliary housing member, and a housing bottom plate member forming said housing; exteriorly accessible first screw means engaging and connecting the bottom plate and main housing member; there being openings formed in the bottom plate member; second screw means also accessible exteriorly of the housing and removable through said openings and engageable with the main and auxiliary members connecting and holding assembled said main and auxiliary members; the main member being located intermediate the auxiliary and bottom plate members and forming an upper compartment above the main member extending between the main and auxiliary members, and a lower compartment below the main member extending between the main and bottom plate members; said power nozzle rotary brush being located in the lower compartment and being journaled at one end in the upper compartment and at its other end in the lower compartment; a partition wafer mounted on the brush adjacent said one brush end through which wafer said brush rotatably extends; said wafer being slidably removably mounted on the main member to locate said one brush end in the upper compartment; said brush drive motor being mounted in the upper compartment; drive belt means in the upper compartment operatively connecting the drive motor and said one brush end; said adjustable nozzle support wheels being mounted in the lower compartment, there being openings formed in the bottom plate through which said wheels are movable to adjusted positions; and said wheel adjusting mechanism being mounted in the lower compartment; whereby upon removal of said second screw means the auxiliary member may be replaced without disturbing the remainder of the power nozzle.

2. The construction defined in claim 1 in which the main, auxiliary and bottom plate housing members have substantially the same rectangular dimensions and peripheral shape.

3. The construction defined in claim 2 in which the openings formed in the bottom plate member, through which said first screw means connecting the main and auxiliary members are accessible, are located generally adjacent the four corners of the nozzle housing.

4. The construction defined in claim 2 in which the rectangular housing members have front and end portions and rear corners; in which a rubber bumper is mounted on the main housing member along said front and end portions and rear corners; and in which the rubber bumper conceals the abutment line between connected auxiliary and main housing members.

5. The construction defined in claim 1 in which the main housing member has a horizontal wall in which upwardly extending recesses are formed wherein first wheels are journaled; and in which other recesses are formed in said horizontal wall comprising portions of the lower compartment to accommodate the shape, position and movement of the adjustable nozzle supporting wheels and the wheel adjusting mechanism mounted in the lower compartment.

6. The construction defined in claim 5 in which the brush drive motor is mounted in a portion of the upper compartment extending between the horizontal wall of the main housir g member and the auxiliary housing member.

7. The construction defined in claim 1 in which the main and auxiliary housing members are formed of molded plastic material; and in which the bottom plate housing member is formed of metal.

* * * * *

UNITED STATES PATENT AND TRADEMARK OFFICE

CERTIFICATE OF CORRECTION

PATENT NO. : 4,199,839

DATED : April 29, 1980

INVENTOR(S) : Eugene F. Martinec

It is certified that error appears in the above-identified patent and that said Letters Patent are hereby corrected as shown below:

Column 1, Line 60 - Between "lint" and "builds" insert the word -which-

Column 4, Line 65 - "hook-shaped" should be -hook-shape-

Column 5, Line 47 - "80" should be -30-

Column 6, Line 57 - "54" should be -34-

Column 6, line 62 - "dust" should be -duct-

Column 7, Line 10 - An insertion from Amendment "A" was not printed, after the numeral "40" and before the period "(.)" as follows: -without disturbing the remainder of the power nozzle unit-.

Signed and Sealed this

*Fifth* Day of *August 1980*

[SEAL]

*Attest:*

SIDNEY A. DIAMOND

*Attesting Officer*

*Commissioner of Patents and Trademarks*